US011324338B2

(12) United States Patent
Ross

(10) Patent No.: US 11,324,338 B2
(45) Date of Patent: May 10, 2022

(54) ALL-INCLUSIVE DIAPER CHANGING AND FEEDING SUPPORT PILLOW

(71) Applicant: Alexandria Ross, Reisterstown, MD (US)

(72) Inventor: Alexandria Ross, Reisterstown, MD (US)

(73) Assignee: Alexandria Ross, Reistertown, MD (US)

( * ) Notice: Subject to any disclaimer, the term of this patent is extended or adjusted under 35 U.S.C. 154(b) by 189 days.

(21) Appl. No.: 16/262,214

(22) Filed: Jan. 30, 2019

(65) Prior Publication Data

US 2019/0231091 A1 Aug. 1, 2019

Related U.S. Application Data

(60) Provisional application No. 62/624,355, filed on Jan. 31, 2018.

(51) Int. Cl.

| | |
|---|---|
| ***A47D 13/08*** | (2006.01) |
| ***A47G 9/10*** | (2006.01) |
| ***A47D 15/00*** | (2006.01) |
| ***A47C 20/02*** | (2006.01) |

(52) U.S. Cl.

CPC ..... *A47D 13/083* (2013.01); *A47C 20/025* (2013.01); *A47D 15/003* (2013.01); *A47G 9/1072* (2013.01)

(58) Field of Classification Search

CPC .... A47D 13/083; A47D 13/00; A47D 15/003; A47D 5/006; A47C 20/025; A47G 9/1072; A47G 9/10

See application file for complete search history.

(56) References Cited

U.S. PATENT DOCUMENTS

| | | | | |
|---|---|---|---|---|
| 5,313,678 | A * | 5/1994 | Redewill | A47C 21/003 297/393 |
| 6,038,720 | A * | 3/2000 | Matthews | A47C 7/383 5/636 |
| 7,464,423 | B2 * | 12/2008 | Goodwin | A45C 9/00 5/640 |
| 7,624,461 | B2 * | 12/2009 | Tidwell | A47D 13/08 5/655 |
| 8,887,333 | B2 * | 11/2014 | Cohen | A47C 27/081 5/639 |
| D817,031 | S * | 5/2018 | Denat | D6/601 |
| 2007/0271703 | A1 * | 11/2007 | Matthews Brown | A47D 15/003 5/636 |
| 2009/0235459 | A1 * | 9/2009 | Tidwell | A47G 9/10 5/640 |
| 2016/0058217 | A1 * | 3/2016 | Cohen | A47C 27/081 5/639 |

* cited by examiner

*Primary Examiner* — David R Hare
(74) *Attorney, Agent, or Firm* — Duane Morris LLP

(57) ABSTRACT

A diaper changing and feeding support device is disclosed. The device includes a U-shaped pillow member with a first arm, a second arm and plurality of securing devices. The first arm includes a plurality of pockets and corresponding zippers, and the second arm includes a plurality of pockets and corresponding zippers. The device also includes a changing pad member with a plurality of detachable changing pads and a plurality of securing devices, the plurality of detachable changing pads adjustable to accommodate a plurality of different lengths and widths.

20 Claims, 7 Drawing Sheets

ALL-INCLUSIVE DIAPER CHANGING AND FEEDING SUPPORT PILLOW

PRIORITY CLAIM AND CROSS-REFERENCE

The present application claims priority benefit of provisional application No. 62/624,355 filed 31 Jan. 2018 entitled "All-Inclusive Diaper Changing and Feeding Support Pillow". The entirety of the above-listed application is hereby incorporated herein by reference.

BACKGROUND

Infant's often need to be changed, prior to, during, or immediately after they have been nursed or fed. Support pillows are used to facilitate feeding and nursing. This invention relates to ways to enhance the use of various embodiments of nursing and feeding pillows. Currently, mothers use body pillows and nursing pillows to support the infant during feeding and then must move everything and carry the infant to the nursery or room where the changing station is in order to change the infant. Or parents opt to place mats and or towels down on the couch or bed to protect the space during the diaper changing but are often still left getting up to search for the diaper changing supplies needed. Changing a baby's diaper in a larger or two-story house presents problems. A traditional layette, i.e., the items needed by parents for the care of a newborn baby, always includes a changing table or padded changing surface filled with the infant changing items. However, permanent diaper changing tables are generally kept in a bedroom or nursery because they are relatively large pieces of furniture, and will not fit in a smaller room. Many mothers may not be feeding or nursing the baby in these spaces. Especially when a baby is younger and requires numerous feedings and changes a day, carrying the baby from room to room between feedings for each change can be exhausting. This is especially true when the one doing the changing is a mother who has recently had a caesarean section, since climbing stairs and constant mobilization many times following abdominal surgery is very difficult and not generally advisable. Older children usually require fewer changes but weigh more and are mobile. Chasing them and carrying them up and down the stairs or from room to room is also inconvenient and tiring.

There is thus a need for a device which will conveniently support a mother and her infant while feeding and nursing while acquiring all the diapering needs. A device that a parent can use to support the infant or child while changing their diaper conveniently where they currently fed or nursed their infant eliminating the need to move from room to room to gather changing supplies. Such a device would be even more useful if it were portable and could be easily moved from place to place while storing all diapering needs.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
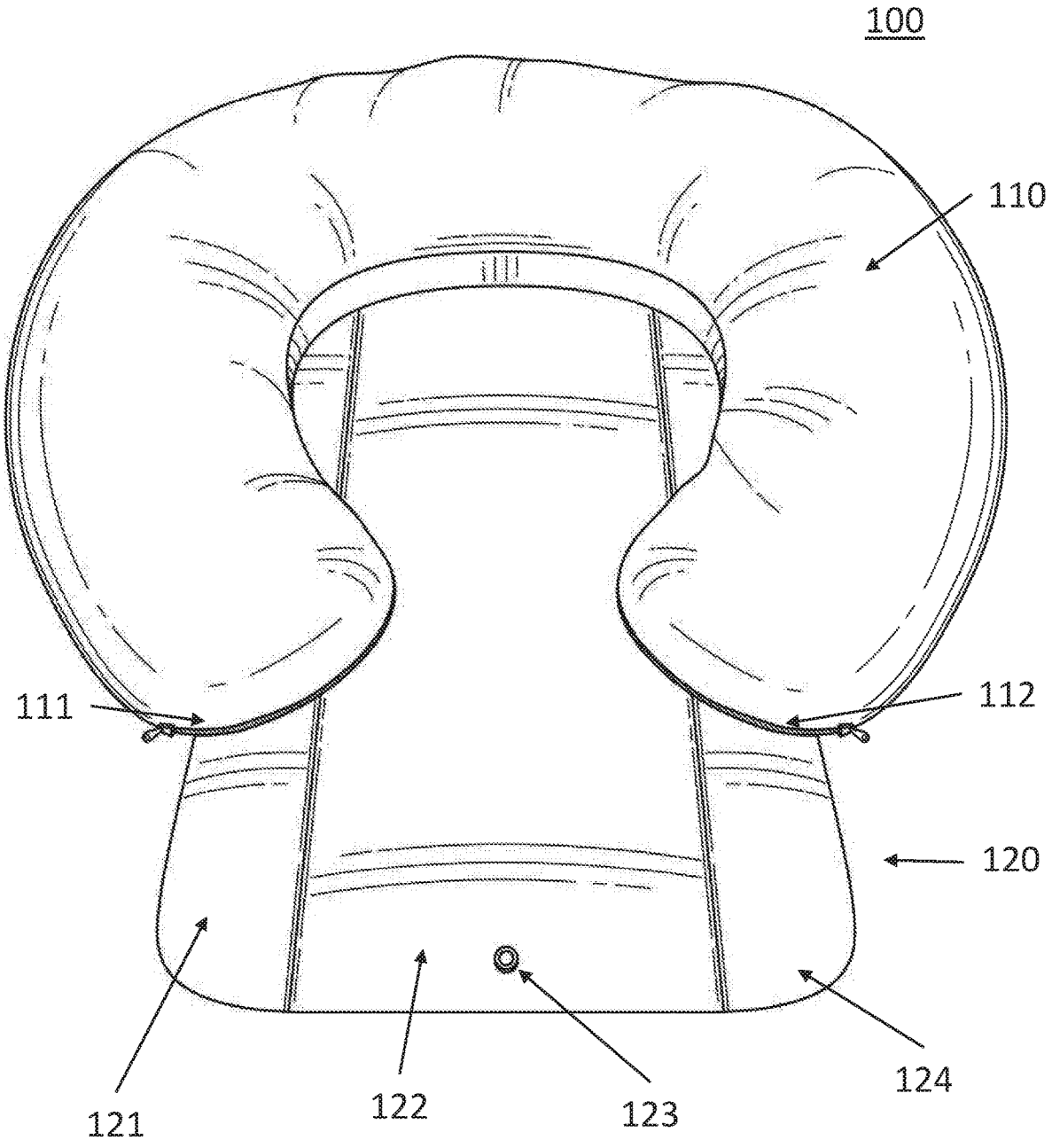
FIG. 1 is an illustration showing the changing pillow with attached changing pad unfolded and open in accordance with some embodiments.

The following disclosure provides many different embodiments, or examples, for implementing different features of the subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is an illustration showing the changing pillow with attached changing pad unfolded and open in accordance with some embodiments. In one embodiment, the invention describes a feeding pillow having a pillow body that is generally defined by a medial region and two opposing arms that extend from the medial region. The medial region is configured to be placed near or adjacent a user's stomach, with the arms generally near or adjacent the user's sides. Also, the pillow's two opposing arms have large internal pockets secured with a zipper. The pillow body comprises a water repellant fabric cover and a fill material disposed within the fabric cover. A removable pad is secured to the pillow body.

In one aspect, the removable pad will be attached to the pillow body by, but not limited to, snaps or zippers. The pad may have additional padding to support the infant during diaper changing. The pad will be able to be folded to securely wrap around the pillow body and be secured. For example, by a snap or Velcro. This is to allow the user to use the support pillow while nursing.

In one aspect, removable pad will be compromised of possible two fabrics, one of which will be able to be wiped and will be water resistant. The removable pad will be machine washable.

In another aspect, the pillow body and arms will support and securely nestle the infant during diaper changing while the infant is placed on the padded wipable pad to further support the infant and decrease the startle reflex during changing.

Optionally, a belt may be attached to the arms. For example, a pair of strap/buckle clips may be used to removably attach the belt to the pillow.

In another embodiment, deep pockets will be internally in the end of each pillow arm. The pockets will be closeable by a zipper, Velcro, or snap. These pockets will allow the user to store diapering supplies for the infant. The pockets will be surrounded by pillow filling in order to cushion the infant at all times so that the infant does not rest on hard supplies from inside the pillow arms.

In one aspect, the pillow may be angled downward from the distal side to the proximal side. Further, the object is a baby who, when placed on the pillow, angles toward the user's chest when resting on the support surface. In this way, the mother may more easily nurse the baby. If needed, the pillow may be secured about the user's waist using a belt.

In a further aspect, the support pillow further comprises a pocket at the top surface of the pillow body. The pocket defines an enclosure into which the support pillow is removably received. This allows the support member to be removed from the pocket. Such a configuration provides the benefit of allowing the pillow and cover to be washed in a washing machine.

In another embodiment, the invention provides a feeding pillow that is constructed of a pillow body that is generally defined by a medial region and two opposing arms. The medial region is configured to be placed near or adjacent a user's stomach, with the arms generally near or adjacent the user's sides. The pillow body has a top surface that is adapted to hold a baby and a bottom surface that is adapted to be placed on the user's lap. Although user can use them interchangeably. The pillow body further includes a fabric cover and a fill material disposed within the fabric cover.

Another embodiment of the invention involves an exemplary feeding pillow that provides a way to store auxiliary components of the pillow and or the user's personal items. An example would be if the user wanted to secure a cell phone or remote control while using the support pillow. The fabric cover may include a pocket at the distal portion of the pillow body to store the user's personal items or securely store the removable belt if not stored in the arm pockets.

The moisture protective covering for pillow and pad may be constructed of a wide variety of materials, such as a wipeable fabric, a waterproof fabric, a water-resistant fabric, a waterproof material, a water-resistant material, a plastic sheet material, a vinyl, and the like. Such materials protect the support member from water or other liquids that come into contact with the support member. Hence, in the event that a liquid is spilled, or, more commonly, the infant's bodily fluids come in contact with the pillow body and/or changing pad, the internal pillow and changing pad, will be protected. Further, if it is desired to clean the support pillow or removable changing pad, the fabric cover and pad may be easily removed so that the fabric cover (or entire pillow) and/or pad may be placed into a washing machine.

The all-inclusive diaper changing and feeding support pillow 100 is a U shaped pillow filled with soft cotton used by mothers to change their child immediately after nursing without having to leave the room for supplies. The all-inclusive changing pillow 100 is covered by a soft, but water resistant fabric that is soft against a baby's skin, yet durable for the wear and tear it might endure. The U shaped pillow has a detachable changing pad that conveniently wraps around the pillow securing with a snap or Velcro. This pad allows convenient diaper changing without worry of infant soiling bed, couch, carpet, or any surface.

Component 110 is a U-shaped pillow covered with a soft water resistant fabric such as Polyurethane Laminate (PUL). The covering is removable and machine washable. The inner pillow is encased by soft machine washable cotton stuffed with a cotton filling.

Components 111 and 112 are zippers and pockets shown on both arms of the pillow. These zippers allow one to secure items placed in the pockets.

Component 123 is the snap or securing device on the washable changing pad that rolls up around the pillow and is then secured for convenience and easy portability. Component 122 is a center panel of the changing pad.

Components 121 and 124 are foldable side panels of the changing pad. unfolds outward to increase surface to place infant on while changing. The pad opens wide enough to fit under pillow embodiment to ensure complete coverage from changing surface such as floor, bed, couch, etc. The exterior side of the changing pad 120 that is made of a softer material such as cotton or fleece. The interior portion of the pillow is made of a water resistant fabric that can be wiped and cleaned as needed.

Figure 2:
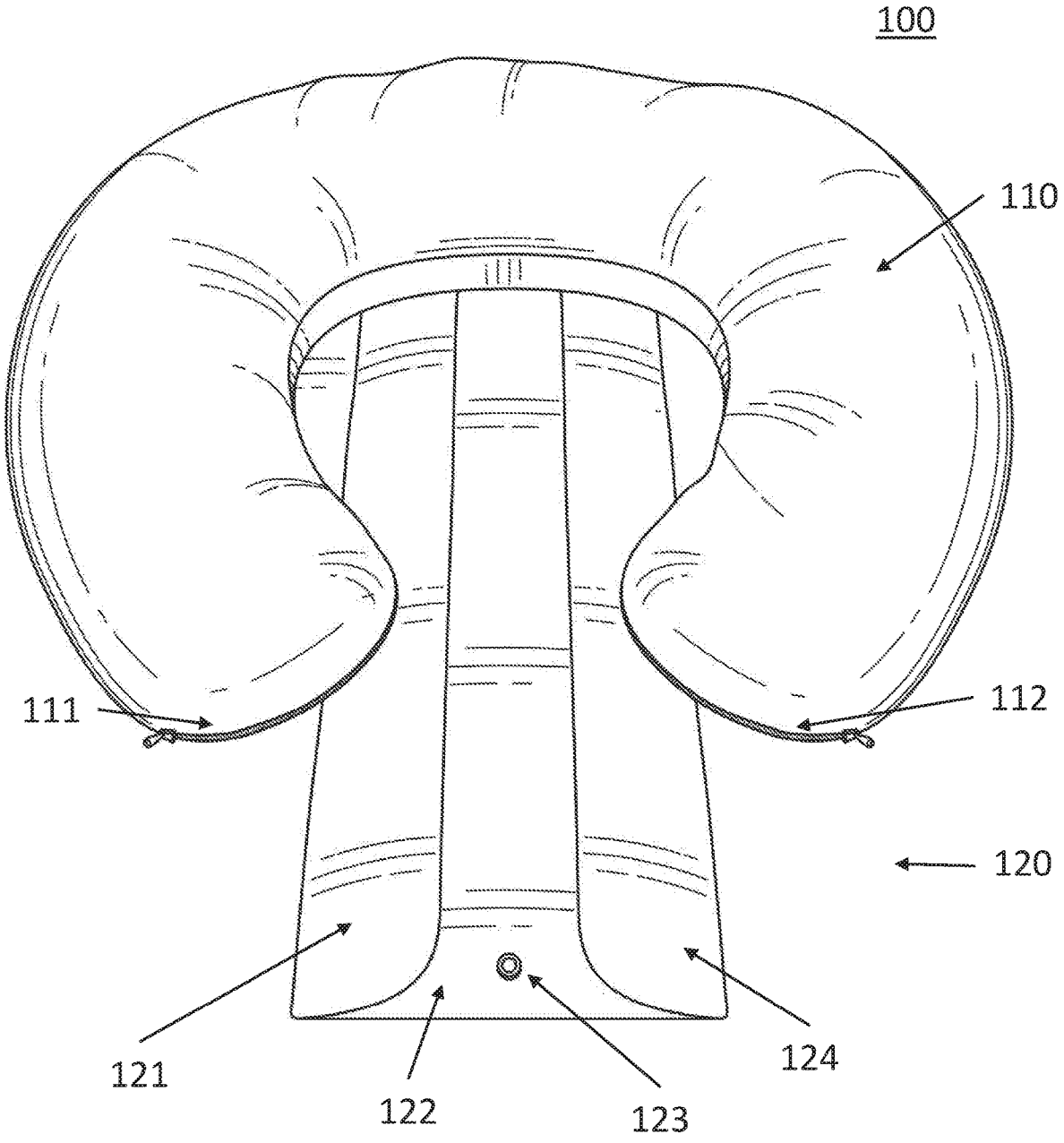
FIG. 2 is an illustration of the changing pillow with changing pad folded in prior to rolling pad around pillow in accordance with some embodiments.

FIG. 2 illustrates the water resistant, detachable changing pad 120 folded inward to allow consumer to then roll pad around the soft pillow.

Figure 3:
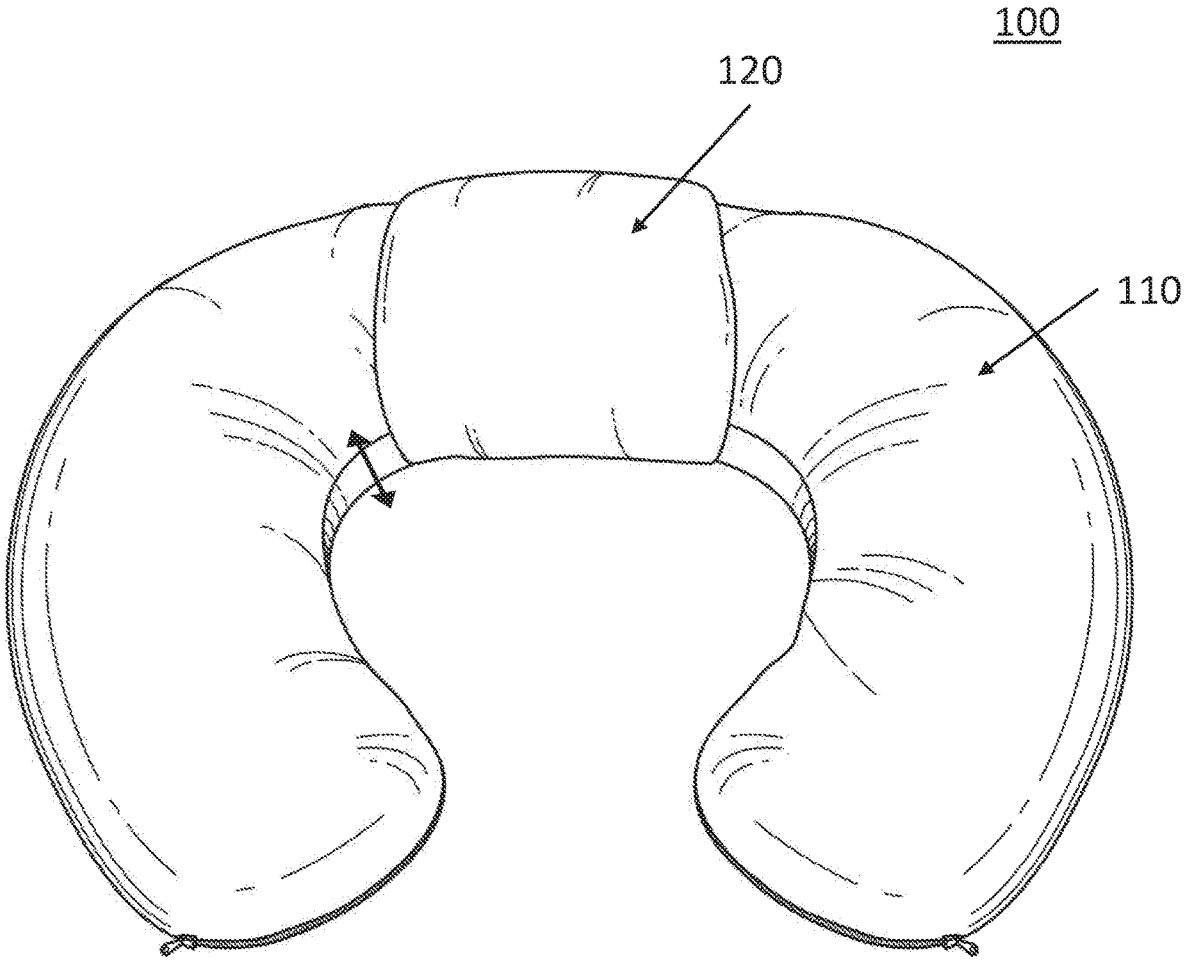
FIG. 3 is an illustration of changing pillow with attached changing pad rolled and secured around pillow in accordance with some embodiments.

FIG. 3 illustrates the detachable changing pad 120 wrapped and secured around the changing pillow 110. Surface shown is soft and does not repel fluids. The pillow measures approximately 2 inches at center of pillow then proceeds to narrow down along the arms bilaterally.

Figure 4:
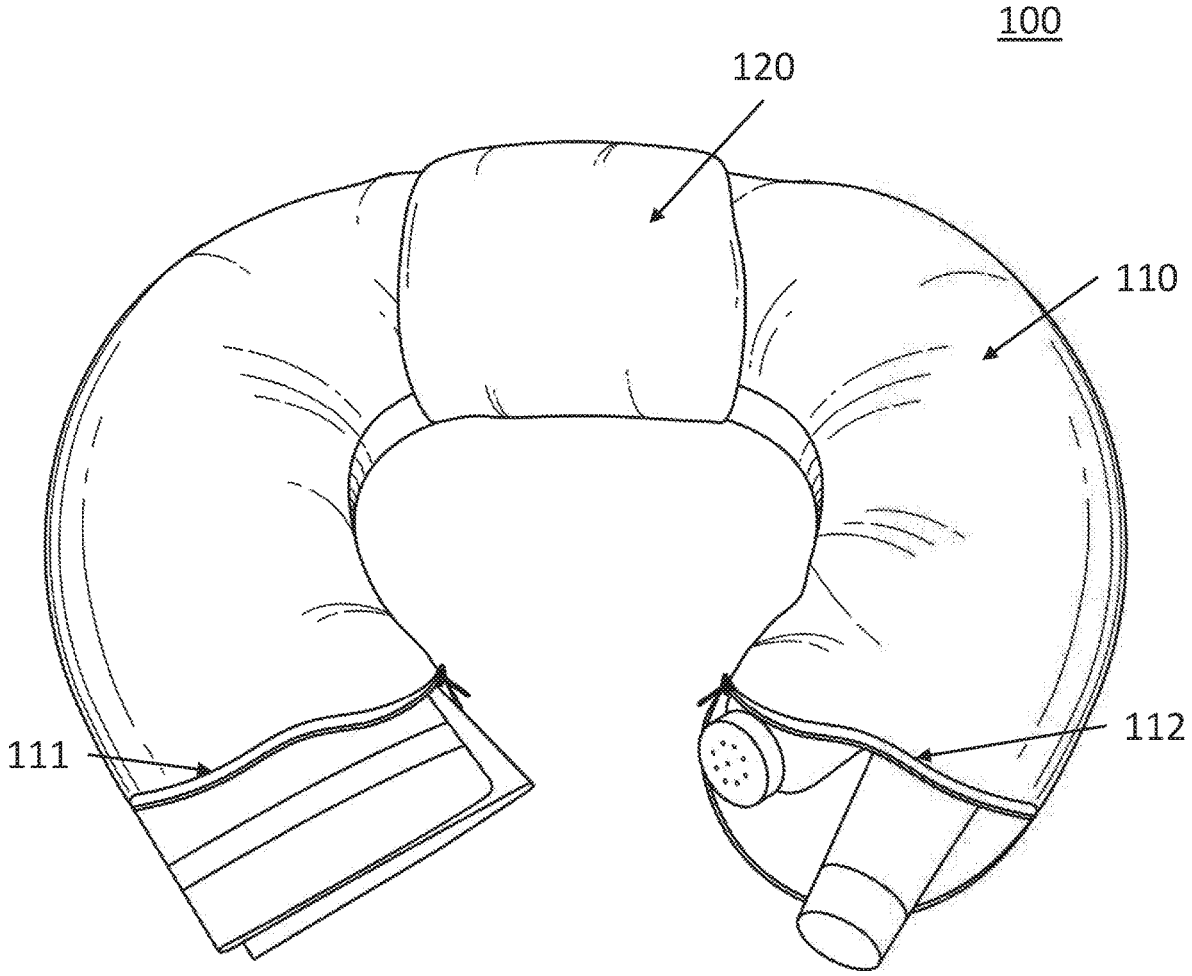
FIG. 4 illustrates changing pillow with attached changing pad rolled around pillow and secured with arm zippers unzipped illustrating compartment for diapering needs such as diapers, wipes, diaper cream and more in accordance with some embodiments.

FIG. 4 illustrates the changing pillow's 110 pockets unzipped. The pockets may be deep enough (approximately 10 inches) to hold diapers, wipes, diaper and/or nipple cream, baby powder, or personal products for mom such as breast pads, cellphone, tissues and more. The pockets are completely surrounded by a soft plush cotton that protects the baby from the products inside. Zippers 111 and 112 may open inward or outward.

Figure 5:
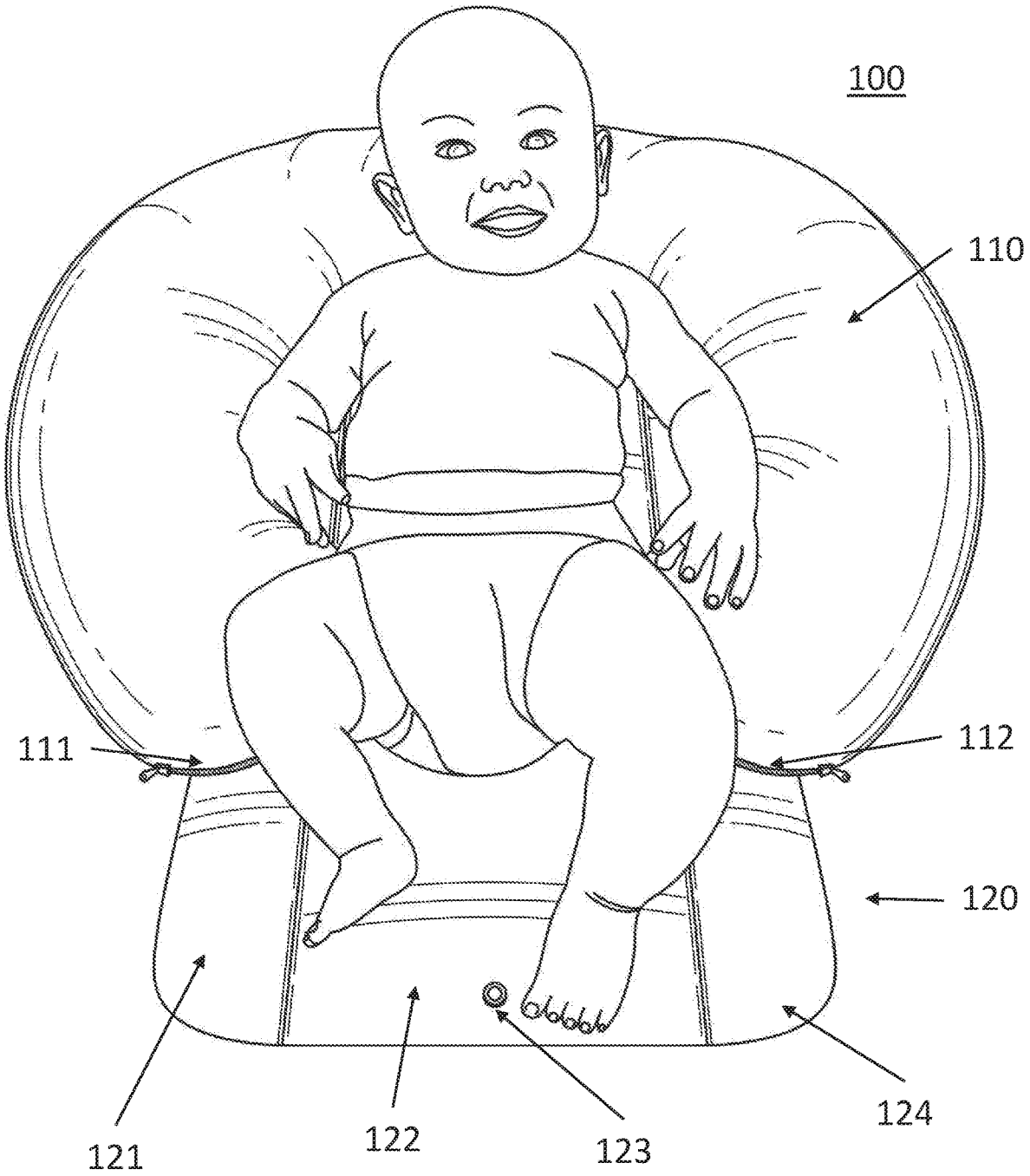
FIG. 5 illustrates changing pillow supporting infant for diapering. Changing pad is rolled out and open, supporting entire length of infant in accordance with some embodiments.

FIG. 5 illustrates the changing pillow 110 supporting the infants head. This allows older children to be propped up and look at their parents while having their diaper changed. The changing pillow 110 supports the infant's neck and shoulders while the infant rests on the changing pillow. The pillow supports the infant while also providing a place for the infant to rest their arms. The U shape of the pillow gives the infant a sense of security by snuggly supporting the child. The water resistant side of changing pad 120 is show underneath the infant during changing. The changing pad 120 supports the entire length of the child.

Figure 6:
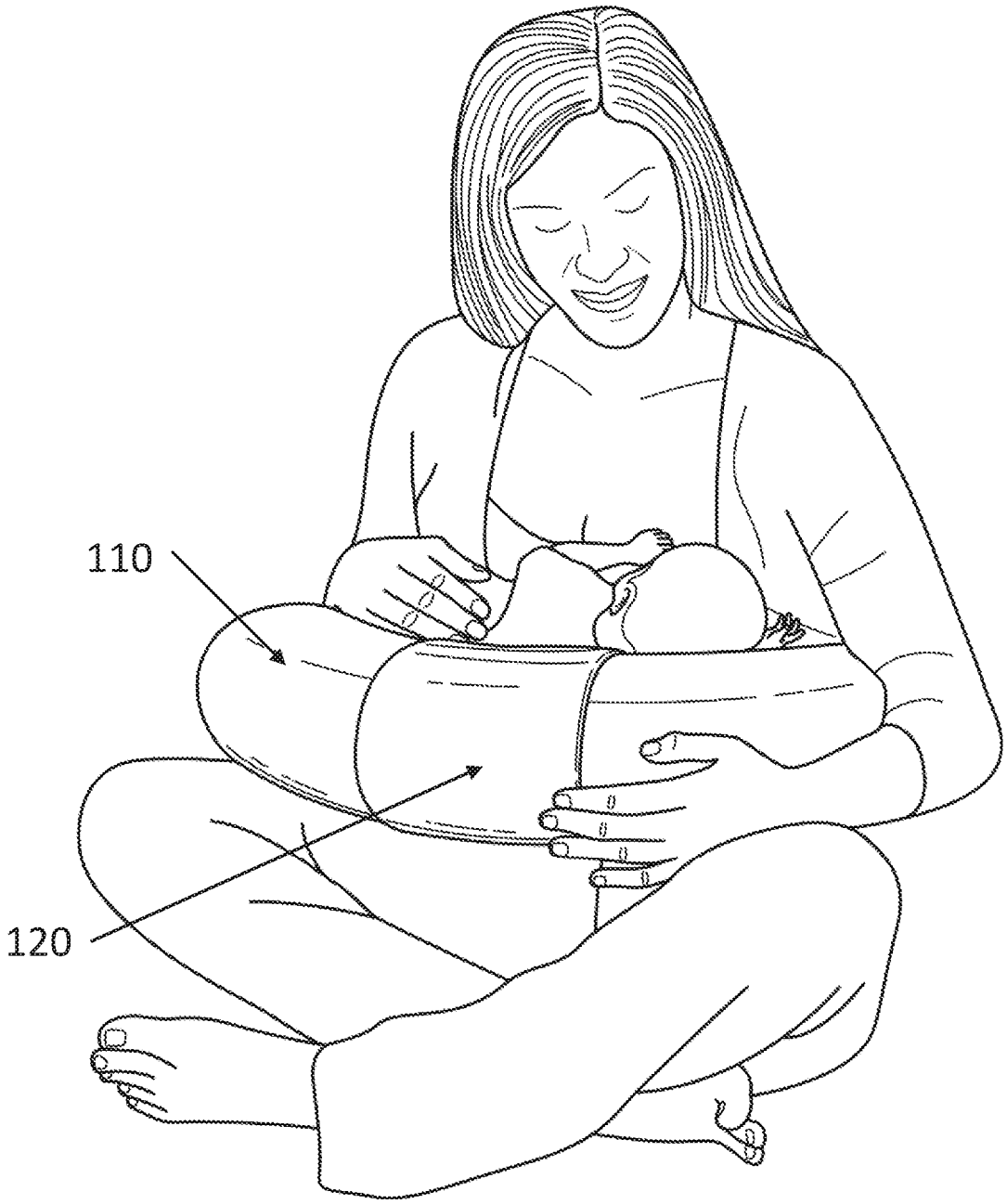
FIG. 6 illustrates mother using all inclusive changing pillow for breastfeeding support in accordance with some embodiments.

FIG. 6 illustrates the infant secured against the mother while breastfeeding. The changing pillow 110 can be utilized as nursing support to ensure mother feels comfortable and secure while holding and breastfeeding her child. The pillow wraps around the mother, supporting her both the child and the mother's arms. The mother may lightly support the pillow as it rests on her lap during breastfeeding. This ensures proper positioning for optimal breastfeeding. The pillow, when wrapped around the mother, and is thick enough to rest on her legs while supporting the infant at the proper height for easier breastfeeding.

Figure 7:
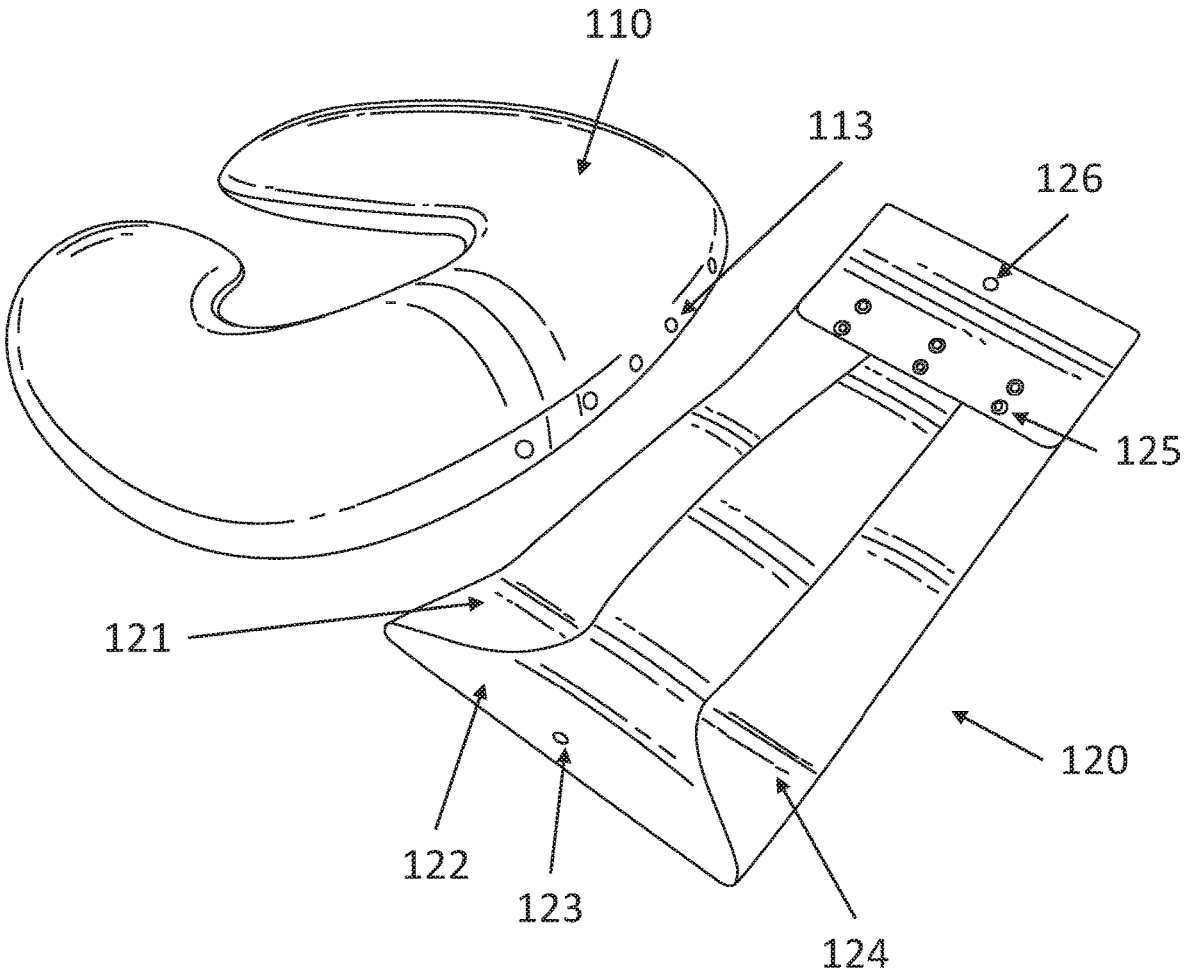
FIG. 7 illustrates changing pad detached from changing pillow. Pillow and pad are able to be utilized separately if consumer desires to do so in accordance with some embodiments.

FIG. 7 illustrates the pillow snaps 113 and the changing pad snaps 125 used to both attach the detachable changing pad 120 as well as secure pillow casing around changing pillow. Component 127 is the snap or securing device that communicates with Component 123 on the washable changing pad that rolls up around the pillow and is then secured for convenience and easy portability. When the pad is not attached, the casing may be shut and secured for continued pillow use. The changing pad 120 easily folds away and can fit in diaper bags and/or purses to be conveniently stored when not attached to the changing pillow 110.

A diaper changing and feeding support device may be made up of a U-shaped pillow member with two arms and a plurality of securing devices. Each arm may include a plurality of pockets and corresponding zippers. The changing pad member may be one of a plurality of detachable changing pads and a plurality of securing devices. The plurality of detachable changing pads may be adjustable to accommodate a plurality of different lengths and widths.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A diaper changing and feeding support device, the device comprising:

a U-shaped pillow member with a pillow filling, a first arm, a second arm and plurality of securing devices, wherein the first arm includes a plurality of pockets and corresponding zippers, and the second arm includes a plurality of pockets and corresponding zippers; and a changing pad member comprising of one of a plurality of detachable changing pads with a plurality of securing devices, wherein the plurality of detachable changing pads adjustable to accommodate a plurality of different lengths and widths;

one of the plurality of pockets in the first arm comprises a first deep pocket configured to store at least diapers, and wherein one of the plurality of pockets in the second arm comprises a second deep pocket configured to store at least diapers wherein the pillow filling substantially surrounds the first deep pocket and second deep pocket.

2. The diaper changing and feeding support device of claim 1, wherein the U-shaped pillow member is covered with a soft water resistant fabric.

3. The diaper changing and feeding support device of claim 2, wherein the soft water resistant fabric is PUL.

4. The diaper changing and feeding support device of claim 1, wherein one side of the changing pad member is made of soft material.

5. The diaper changing and feeding support device of claim 4, wherein the soft material is cotton.

6. The diaper changing and feeding support device of claim 4, wherein the soft material is fleece.

7. The diaper changing and feeding support device of claim 1, wherein one side of the changing pad member is made of water resistant fabric.

8. The diaper changing and feeding support device of claim 7, wherein the resistant fabric is PUL.

9. The diaper changing and feeding support device of claim 1, wherein the changing pad member can be folded or unfolded to change the surface size of the changing pad member.

10. The diaper changing and feeding support device of claim 1, wherein the changing pad member can be folded inward to roll the changing pad member around the U-shaped pillow member.

11. The diaper changing and feeding support device of claim 10, wherein the changing pad member can be further secured around the U-shaped pillow member after being rolled around the U-shaped pillow member.

12. The diaper changing and feeding support device of claim 11, wherein the height at the center of the U-shaped pillow member with the changing pad member rolled around the U-shaped pillow member is greater than or equal to 2 inches.

13. The diaper changing and feeding support device of claim 1, wherein the depth of the first deep pocket is less than or equal to 10 inches.

14. The diaper changing and feeding support device of claim 1, wherein the depth of the second deep pocket is less than or equal to 10 inches.

15. The diaper changing and feeding support device of claim 1, wherein the plurality of securing devices on the U-shaped pillow member can be secured to the plurality of securing devices of the changing pad member in a plurality of different configurations.

16. The diaper changing and feeding support device of claim 1, wherein the plurality of securing devices on the U-shaped pillow member are snaps.

17. The diaper changing and feeding support device of claim 16, wherein the plurality of securing devices of the changing pad member are snaps.

18. The diaper changing and feeding support device of claim 17, wherein the snaps on the U-shaped pillow member match the snaps on the changing pad member.

19. A diaper changing and feeding support device, the device comprising:

a U-shaped pillow member with a pillow filling, a first arm, a second arm and plurality of securing devices, wherein the first arm includes a plurality of pockets and corresponding zippers, and the second arm includes a plurality of pockets and corresponding zippers; and a changing pad member comprising of one of a plurality of detachable changing pads with a plurality of securing devices, the plurality of detachable changing pads are adjustable to accommodate a plurality of different lengths and widths;

one of the plurality of pockets in the first arm comprises a first deep pocket configured to store at least diapers, and wherein one of the plurality of pockets in the second arm comprises a second deep pocket configured to store at least diapers;

the pillow filling substantially surrounds the first deep pocket and second deep pocket;

the changing pad member can be configured with a left member and a right member, the left member and right member folded or unfolded to change the surface size of the changing pad member;

the changing pad member can be rolled around the U-shaped pillow member while the left member and right member are folded;

the height of the U-shaped pillow member with the changing pad member rolled around the U-shaped pillow member is at least 2 inches;

the plurality of securing devices of the U-shaped pillow are snaps; the plurality of securing devices of the changing pad are snaps; wherein the snaps on the U-shaped pillow member match the snaps on the changing pad member;

the U-shaped pillow member is covered with a soft water resistant fabric; one side of the changing pad member is made of a soft water resistant fabric; the water resistant fabric is PUL;

one side of the changing pad member is made of a soft material; the soft material is cotton or fleece;

wherein the depth of the first deep pocket is less than or equal to 10 inches, and the depth of the second deep pocket is less than or equal to 10 inches.

20. A diaper changing and feeding support device, the device comprising:

a U-shaped pillow member with a pillow filling;

a first arm;

a second arm;

a plurality of securing devices, wherein the first arm includes a plurality of pockets and corresponding zippers, and the second arm includes a plurality of pockets and corresponding zippers;

a changing pad member comprising:

a detachable changing pad, wherein the detachable changing pad comprises a plurality of securing devices;

a bottom side made of cotton or fleece; and a top side made of a water resistant fabric;

the changing pad member is configured to be rolled around the U-shaped pillow member and secured to the U-shaped pillow member via one of the plurality securing devices on the U-shaped pillow member and one of the plurality of securing devices on the changing pad member such that the top side of the changing pad member is completely concealed;

one of the plurality of pockets in the first arm comprises a first deep pocket configured to store at least diapers;

said first deep pocket having an opening at the distal end of the first arm one of the plurality of pockets in the second arm comprises a second deep pocket configured to store at least diapers; and said second deep pocket having an opening at the distal end of the second arm.

* * * * *